US011959673B2

(12) United States Patent
Wallet-Laily et al.

(10) Patent No.: US 11,959,673 B2
(45) Date of Patent: Apr. 16, 2024

(54) ENHANCED METHOD OF LUBRICATION FOR REFRIGERATION COMPRESSORS

(71) Applicant: Carrier Corporation, Palm Beach Gardens, FL (US)

(72) Inventors: Jeremy Wallet-Laily, Saint Cyr au mont d'or (FR); Ulf J. Jonsson, South Windsor, CT (US); Charbel Rahhal, Lyons (FR); Nicolas Fonte, Montluel (FR); Zaffir A. Chaudhry, South Glastonbury, CT (US); David M. Rockwell, Cicero, NY (US); Amit Vaidya, Jamesville, NY (US); Scott M. MacBain, Syracuse, NY (US); Yifan Qiu, Manilus, NY (US); Benjamin J. Blechman, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 539 days.

(21) Appl. No.: 17/251,062

(22) PCT Filed: Jun. 26, 2018

(86) PCT No.: PCT/IB2018/000799
§ 371 (c)(1),
(2) Date: Dec. 10, 2020

(87) PCT Pub. No.: WO2020/002961
PCT Pub. Date: Jan. 2, 2020

(65) Prior Publication Data
US 2021/0247115 A1 Aug. 12, 2021

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2341/0014* (2013.01); *F25B 2341/0015* (2013.01); *F25B 2341/0016* (2013.01)

(58) Field of Classification Search
CPC ..... F25B 43/02; F25B 31/004; F25B 2341/0014; F25B 2341/0015; F25B 2341/0016
See application file for complete search history.

(56) References Cited

U.S. PATENT DOCUMENTS 3,999,893 A 12/1976 Kishi
4,375,156 A 3/1983 Shaw
(Continued)

FOREIGN PATENT DOCUMENTS

DE 19755484 A1 6/1999
FR 2128431 A1 * 3/1971
FR 2128431 A1 10/1972

OTHER PUBLICATIONS

Pdf is translation of foreign reference FR-2128431-A1 (Year: 1971).*
(Continued)

*Primary Examiner* — Len Tran
*Assistant Examiner* — Kamran Tavakoldavani
(74) *Attorney, Agent, or Firm* — CANTOR COLBURN LLP

(57) ABSTRACT

A refrigeration system includes a compressor for compressing a refrigerant, a condenser for cooling the refrigerant, an evaporator for heating the refrigerant, and a lubrication system for providing a lubricant mist to a movable component of the compressor. The lubrication system includes an ejector arranged in fluid communication with the compressor and the evaporator, wherein the lubricant mist is carried by the refrigerant to the movable component.

15 Claims, 4 Drawing Sheets

(56) References Cited

U.S. PATENT DOCUMENTS

| | | | | |
|---|---|---|---|---|
| 4,439,121 | A | 3/1984 | Shaw | |
| 4,541,738 | A | 9/1985 | Leibensperger et al. | |
| 5,469,713 | A | 11/1995 | Wardle et al. | |
| 5,651,257 | A | 7/1997 | Kasahara et al. | |
| 5,653,585 | A | 8/1997 | Fresco | |
| 5,765,392 | A | 6/1998 | Baur | |
| 5,779,004 | A | 7/1998 | Hoshino et al. | |
| 6,074,187 | A | 6/2000 | Kawada et al. | |
| 6,182,467 | B1 * | 2/2001 | Zhong | F25B 31/004 62/505 |
| 8,104,298 | B2 | 1/2012 | Sishtla | |
| 8,568,608 | B2 | 10/2013 | Shiflett et al. | |
| 9,464,832 | B2 | 10/2016 | Higashiiue | |
| 9,541,312 | B2 | 1/2017 | Woolley et al. | |
| 2012/0180510 | A1 * | 7/2012 | Okazaki | F25B 13/00 62/218 |
| 2016/0047575 | A1 * | 2/2016 | Jonsson | F25B 1/053 62/117 |

OTHER PUBLICATIONS

Second Chinese Office Action; Chinese Application No. 201880095083.3; dated Apr. 19, 2022; 16 pages.

International Search Report of the International Searching Authority; International Application No. PCT/IB2018/000799; International Filing Date: Jun. 26, 2018; dated Mar. 15, 2019; 5 pages.

Written Opinion of the International Searching Authority; International Application No. PCT/IB2018/000799; International Filing Date: Jun. 26, 2018; dated Mar. 15, 2019; 7 pages.

First Chinese Office Action; Chinese Application No. 201880095083.3; dated Oct. 28, 2021; 13 pages.

Jacobson, B., "Ball Beating Lubrication in Refrigetation Compressors" (1996); International Compressor Engineering Conference; pp. 1-7.

* cited by examiner

ENHANCED METHOD OF LUBRICATION FOR REFRIGERATION COMPRESSORS

CROSS REFERENCE TO RELATED APPLICATIONS

This application is a National Stage Application of PCT/IB2018/000799, filed Jun. 26, 2018, which is incorporated by reference in its entirety herein.

BACKGROUND

Embodiments of the disclosure relate generally to compressor systems and, more particularly, to lubrication of one or more moving components of a compressor of a refrigeration system.

A vapor compression system includes a compressor, a condenser, an expansion device and an evaporator and refrigerant circulates through these components in a closed circuit. The compressor is typically provided with a lubricant, such as oil, which is used to lubricate bearings and/or other running surfaces. Within the compressor, the lubricant mixes with the refrigerant such that refrigerant discharged from the compressor includes a substantial quantity of lubricant. This may be undesirable because it may difficult to maintain an adequate supply of lubricant necessary to lubricate the compressor surface.

In existing systems, an oil separator has been utilized immediately downstream of the compressor. While oil separators do facilitate separation of oil from the refrigerant, they have not always provided fully satisfactory results. As an example, the oil removed from such a separator will be at a high pressure, and may have an appreciable amount of refrigerant still mixed in with the oil. This lowers the viscosity of the oil. The use of a separator can also cause a pressure drop in the compressed refrigerant, which may be undesirable.

BRIEF DESCRIPTION

According to an embodiment, a refrigeration system includes a compressor for compressing a refrigerant, a condenser for cooling the refrigerant, an evaporator for heating the refrigerant, and a lubrication system for providing a lubricant mist to a movable component of the compressor. The lubrication system includes an ejector arranged in fluid communication with the compressor and the evaporator, wherein the lubricant mist is carried by the refrigerant to the movable component.

In addition to one or more of the features described above, or as an alternative, in further embodiments a stream of refrigerant is expelled from the ejector and the stream of refrigerant has droplets of lubricant entrained therein.

In addition to one or more of the features described above, or as an alternative, in further embodiments the ejector has a primary inlet and a secondary inlet, the primary inlet being coupled to an outlet of the compressor such that the refrigerant output from the compressor is a motive fluid of the ejector.

In addition to one or more of the features described above, or as an alternative, in further embodiments the secondary inlet is coupled to an outlet of the evaporator such that a lubricant rich refrigerant is drawn into the ejector via the secondary inlet by the motive fluid.

In addition to one or more of the features described above, or as an alternative, in further embodiments the lubricant rich refrigerant is at least partially a liquid.

In addition to one or more of the features described above, or as an alternative, in further embodiments the outlet of the evaporator is arranged adjacent a bottom of the evaporator.

In addition to one or more of the features described above, or as an alternative, in further embodiments the lubricant rich refrigerant provided to the ejector from the evaporator is less than 2% of a total mass flow of refrigerant in the evaporator.

In addition to one or more of the features described above, or as an alternative, in further embodiments the lubrication system further comprises a tank, and the stream of refrigerant having droplets of lubricant entrained therein is provided to the tank.

In addition to one or more of the features described above, or as an alternative, in further embodiments the lubrication system further comprises a secondary ejector arranged in fluid communication with the compressor and the tank.

In addition to one or more of the features described above, or as an alternative, in further embodiments the secondary ejector has a primary inlet and a secondary inlet, the primary inlet of the secondary ejector being coupled to the outlet of the compressor such that the refrigerant output from the compressor is a motive fluid of the secondary ejector.

In addition to one or more of the features described above, or as an alternative, in further embodiments the secondary inlet of the secondary ejector is coupled to the tank such that the stream of refrigerant having lubricant entrained therein is drawn into the secondary inlet of the secondary ejector by the motive fluid.

In addition to one or more of the features described above, or as an alternative, in further embodiments a stream of refrigerant having droplets of lubricant entrained therein is output from the secondary ejector.

In addition to one or more of the features described above, or as an alternative, in further embodiments the stream of refrigerant output from the ejector has a greater amount of lubricant than the stream of refrigerant output from the secondary ejector.

In addition to one or more of the features described above, or as an alternative, in further embodiments an outlet of the secondary ejector is in fluid communication with the movable component of the compressor.

In addition to one or more of the features described above, or as an alternative, in further embodiments the stream of refrigerant having droplets of lubricant entrained therein output from the secondary ejector is directed into the tank, and at least one conduit couples the tank to the movable component to deliver the stream of refrigerant having droplets of lubricant entrained therein to the movable component.

In addition to one or more of the features described above, or as an alternative, in further embodiments the lubrication system further comprises a secondary ejector arranged in fluid communication with the compressor and the movable component.

In addition to one or more of the features described above, or as an alternative, in further embodiments the secondary ejector includes a primary inlet and a secondary inlet, the primary inlet being coupled to the outlet of the compressor and the second inlet being coupled to the movable component.

In addition to one or more of the features described above, or as an alternative, in further embodiments the movable component includes at least one bearing.

In addition to one or more of the features described above, or as an alternative, in further embodiments the at least one bearing includes a plurality of bearings, and the lubrication system is configured to deliver lubricant to the plurality of bearings, individually.

According to another embodiment, a refrigeration system includes a compressor for compressing a refrigerant, a condenser for cooling the refrigerant, an evaporator for heating the refrigerant, a tank and a lubrication system including an ejector for drawing oil from the evaporator and delivering a mixture of refrigerant and oil to the tank.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
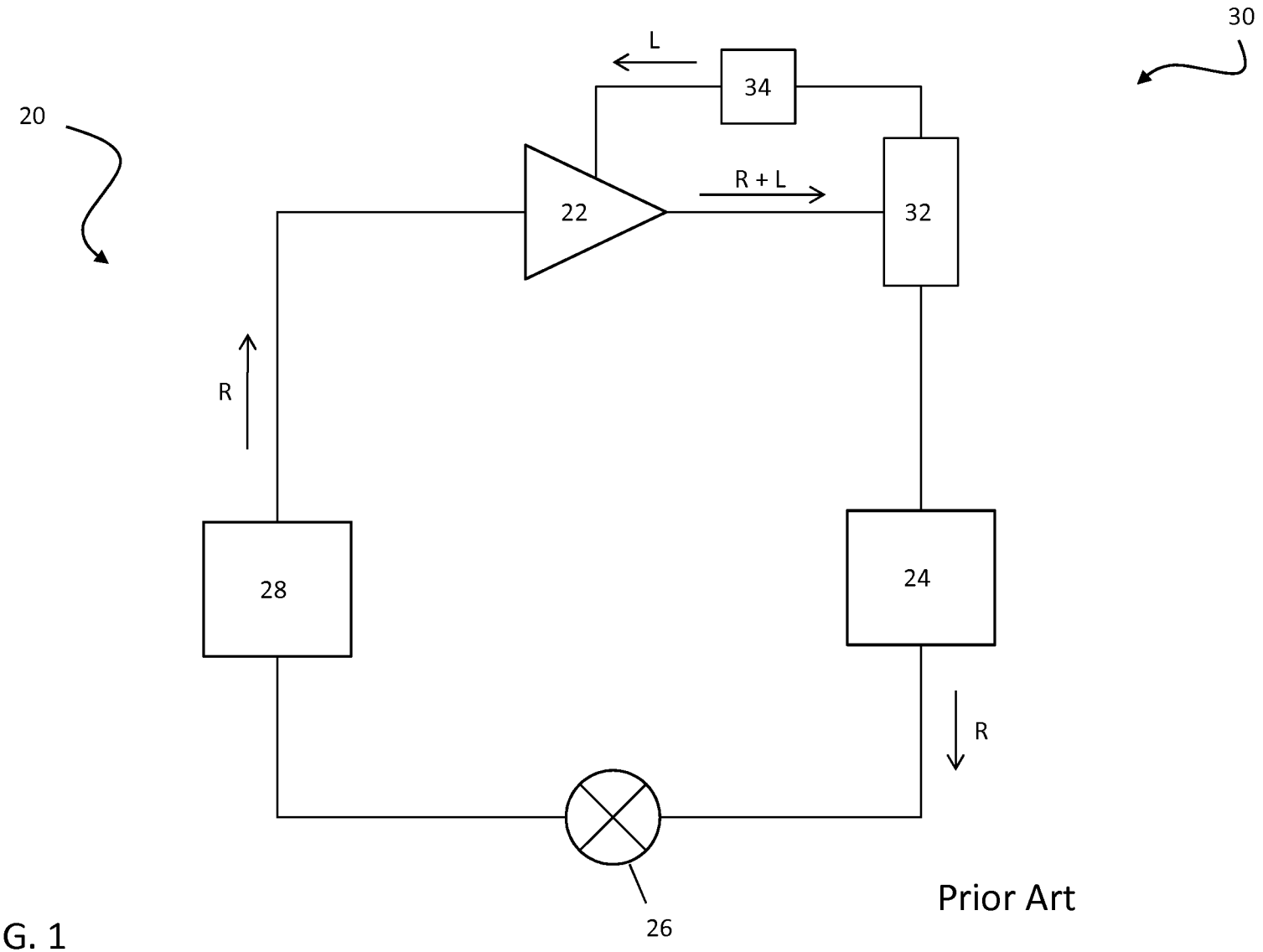
Prior Art FIG. 1
FIG. 1 is a schematic diagram of an existing refrigeration system including a lubrication system.

Referring now to FIG. 1, an example of an existing vapor compression or refrigeration cycle 20 of an air conditioning system is schematically illustrated. A refrigerant R is configured to circulate through the vapor compression cycle 20 such that the refrigerant R. absorbs heat when evaporated at a low temperature and pressure and releases heat when condensed at a higher temperature and pressure. Within this cycle 20, the refrigerant R flows in a clockwise direction as indicated by the arrows. The compressor 22 receives refrigerant vapor from the evaporator 28 and compresses it to a higher temperature and pressure, with the relatively, hot vapor then passing to the condenser 24 where it is cooled and condensed to a liquid state by a heat exchange relationship with a cooling medium such as air or water. The liquid refrigerant R then passes from the condenser 24 to an expansion valve 26, wherein the refrigerant R is expanded to a low temperature two phase liquid/vapor state as it passes to the evaporator 18. After the addition of heat in the evaporator 28, low pressure vapor then returns to the compressor 22 where the cycle is repeated.

A lubrication system, illustrated schematically at 30, may be integrated into the refrigeration system. Because lubricant L may become entrained in the refrigerant as it passes through the compressor 22, an oil separator 32 is positioned directly downstream from the compressor 22. The refrigerant R separated by the oil separator 32 is provided to the condenser 24, and the lubricant L isolated by the oil separator 32 is provided to a lubricant reservoir 34 configured to store a supply of lubricant L. Lubricant from the reservoir 34 is then supplied to some of the moving portions of the compressor 22, such as to the rotating bearings for example, where the lubricant L becomes entrained in the refrigerant, illustrated at R+L, and the cycle is repeated. The oil reservoir 34 can also be integrated in the oil separator 32.

Figure 2:
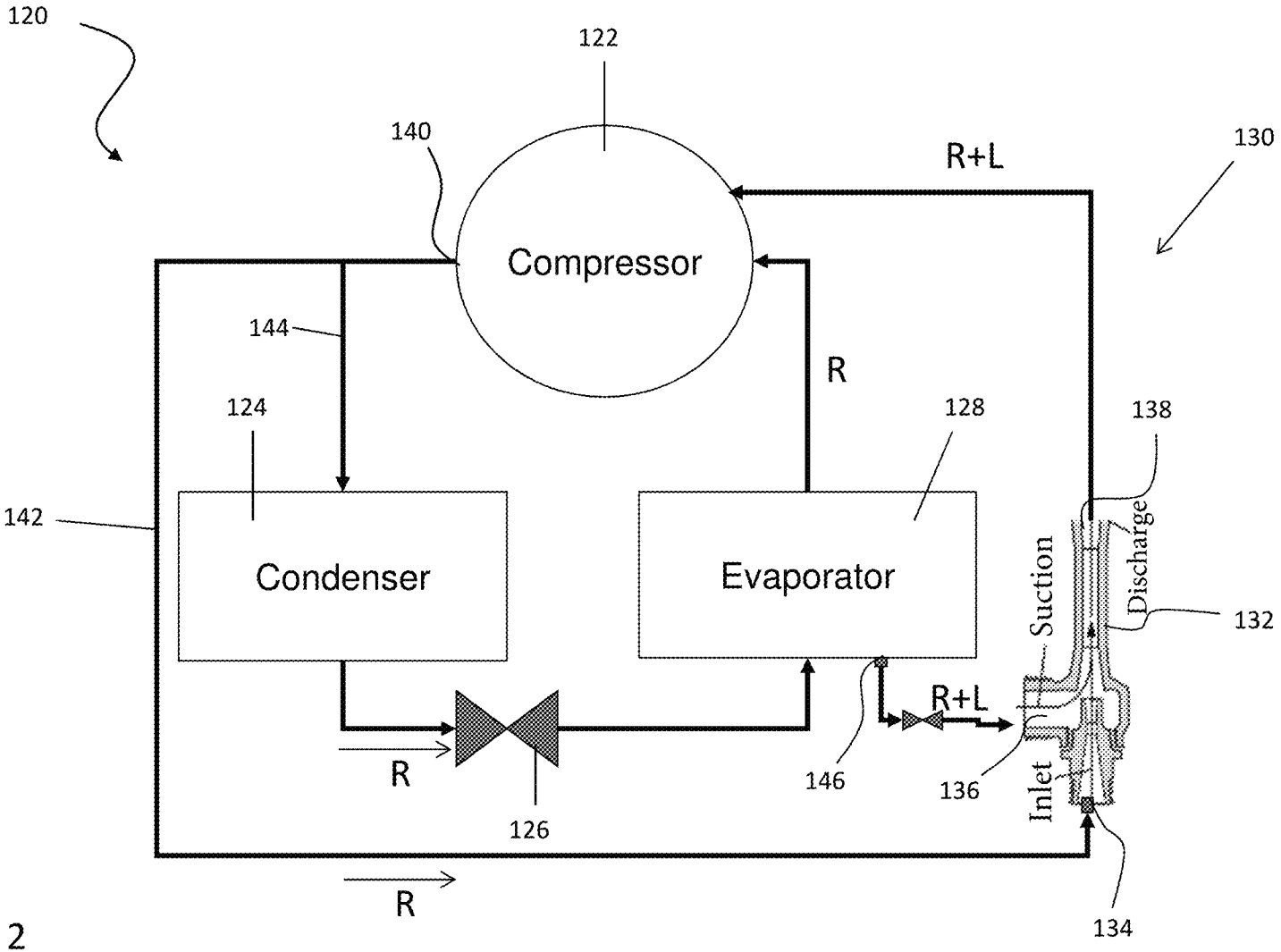
FIG. 2 is a schematic diagram of a refrigeration system including a lubrication system according to an embodiment.
Figure 3:
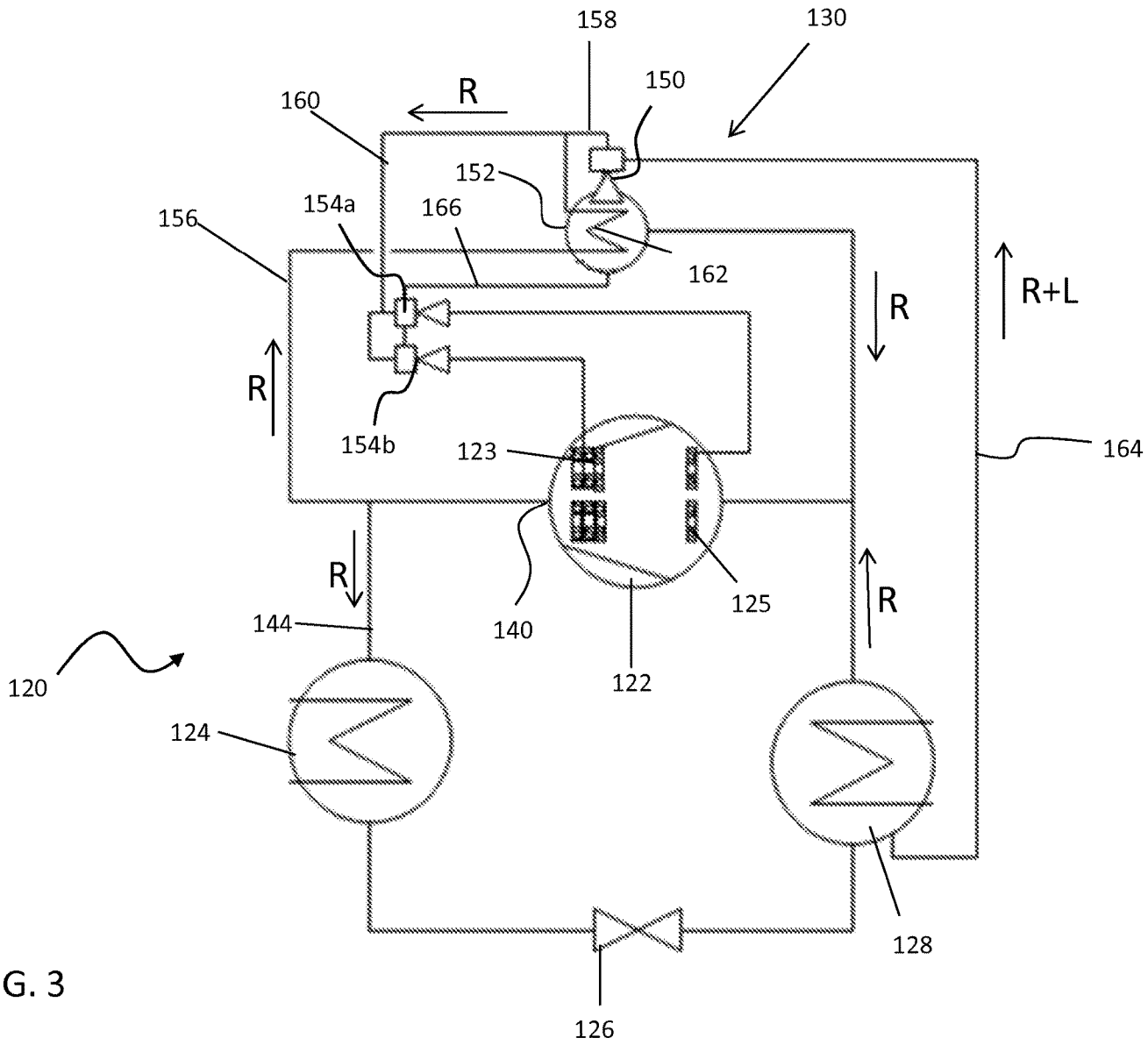
FIG. 3 is a schematic diagram of a refrigeration system including a lubrication system according to another embodiment.

In existing systems, such as shown in FIG. 1, the lubricant L is typically provided to bearings or other moving components of the compressor 22 as a fluid stream, or alternatively, as large droplets. The flow rate of the lubricant L in such systems is typically between about 100 mL/min and 10 L/min. A refrigeration cycle 120 including an alternative system configured to more efficiently lubricate the compressor 122 is shown in FIG. 2. Similar to the system of FIG. 1, the vapor compression cycle 120 includes a compressor 122, a condenser 124, an expansion device 126, and an evaporator 128 arranged in fluid communication with one another. In its most simplistic configuration, a lubrication system 130 arranged in fluid communication with the vapor compression cycle 120 includes an ejector 132.

The ejector 132 includes a first fluid inlet 134, a second fluid inlet 136, and an outlet 138. The first fluid inlet 134 is operable as a primary inlet and the second fluid inlet 136 functions as a suction inlet. In the illustrated, non-limiting embodiment of FIG. 2, the first fluid inlet 134 is arranged downstream from and in communication with an outlet 140 of the compressor 122. As shown in the FIG., the fluid flow path 142 extending between the compressor outlet 140 and the primary inlet 134 is arranged generally parallel to the fluid flow path 144 extending between the compressor outlet 140 and the condenser 124.

The secondary inlet 136 of the ejector 132 is configured to receive a fluid from the evaporator 128. The refrigerant output from the compressor outlet 140 is a hot, refrigerant vapor having some lubricant entrained therein. The vapor transforms into liquid in condenser 124 forming a liquid form of refrigerant and lubricant mixture. When this combined refrigerant and lubricant mixture reaches the evaporator 128, the lubricant has a tendency to accumulate within a portion of the evaporator 128, such as at the bottom of the evaporator 128 for example. Accordingly, the fluid drawn from the evaporator 128 and provided to the secondary inlet 136 via conduit 146 is a lubricant rich liquid refrigerant. In an embodiment, the fluid from the evaporator 128 provided to the ejector 132 is only a very small portion of the total mass flow within the evaporator 128, such as less than 2%, less than 1%, or in some embodiments, less than 0.5% of the total mass flow of the evaporator 128 for example.

The refrigerant vapor provided at the outlet 140 of the compressor 122 functions as the motive flow provided to the primary inlet 134 of the ejector via line 142. As the refrigerant vapor enters the ejector 132 and is accelerated, the pressure drop within the ejector 132 causes the lubricant rich refrigerant from the evaporator 128 to be drawn into the ejector 132 via the secondary inlet 136. This lubricant rich refrigerant becomes entrained within the refrigerant vapor stream as minute droplets, or alternatively, as a mist or aerosol. The refrigerant vapor having a small amount of lubricant entrained therein is then provided to the compressor 122, separate from the normal flow of refrigerant associated with the vapor-compression cycle. The lubricant entrained refrigerant will be supplied to the bearings and deposited onto the bearing surfaces.

In another embodiment, the lubricant system 130 associated with the vapor-compression system 120 includes a plurality of ejectors. As shown, the system 120 may include a recovery ejector 150 associated with a tank 152, and at least one misting ejector 154 configured to deliver a refrigerant having small droplets of lubricant entrained therein to the moving components, such as bearings 123 and 125 for example, of the compressor 122. In the illustrated, non-limiting embodiment, the at least one misting ejector includes a first misting ejectors 154 configured to deliver a lubricant enriched refrigerant to a first set of bearings 123 of the compressor and a second misting ejector 154*b* configured to deliver a lubricant enriched refrigerant to a second set of bearings 125 of the compressor 122, due to the difference in pressure at the bearings 123, 125. However, embodiments where a single ejector 154 is used to deliver lubricant enriched refrigerant is also within the scope of the disclosure.

The hot vapor refrigerant provided at the outlet 140 of the compressor 122 is used as the motive flow for each of the ejectors 150, 154. As shown, a fluid flow path 156 extending between the compressor outlet 140 and the tank 152 is arranged generally parallel to the fluid flow path 144 extending between the compressor outlet 140 and the condenser 124. After passing through the tank 152, the vapor refrigerant is divided into two parallel flow paths, via a first conduit 158 leading to the recovery ejector 150 and a second conduit 160 leading to the at least one misting ejector 154.

In an embodiment, a heat exchanger 162 is disposed within the tank 152. However, embodiments of the system 130 that do not include the heat exchanger 162 are also within the scope of the disclosure. In embodiments including the heat exchanger 162, the hot, vapor refrigerant is configured to transfer heat to an adjacent fluid stored within the tank 152 as it passes through the heat exchanger 162.

A primary inlet of the recovery ejector 150 is configured to receive the hot vapor refrigerant from the compressor outlet 140, and the secondary inlet of the recovery ejector is arranged in fluid communication with the evaporator 128 via conduit 164. Accordingly, the hot vapor refrigerant acts as the motive fluid to draw a lubricant rich liquid refrigerant from the evaporator 128 into the ejector 150. This lubricant rich refrigerant becomes entrained within the refrigerant vapor stream as minute droplets, or alternatively, as a mist or aerosol. The refrigerant vapor having a small amount of lubricant entrained therein is expelled from the recovery ejector into the tank 152. In embodiments where a heat exchanger 162 is located within the tank 152, the refrigerant vapor having the lubricant entrained therein is arranged in a heat transfer relationship with the hot vapor refrigerant within the heat exchanger 162. The refrigerant and lubricant mixture output from the recovery ejector 150 accumulates within the tank 152.

A primary inlet of each of the misting ejectors 154*a*, 154*b*, is configured to receive the hot vapor refrigerant from the compressor outlet 140 via conduit 160, and the secondary inlet of the misting ejectors 154*a*, 154*b* is arranged in fluid communication with the tank 152 via a conduit 166. Accordingly, the hot vapor refrigerant acts as the motive fluid to draw the lubricant rich refrigerant from the tank 152 into the ejectors 154*a*, 154*b*. This lubricant rich refrigerant becomes entrained within the refrigerant vapor stream as minute droplets or a mist or aerosol. The refrigerant vapor having a small amount of lubricant entrained therein is expelled from the ejectors 154*a*, 154*b*, and is provided to the bearings 123, 125, respectively.

Figure 4:
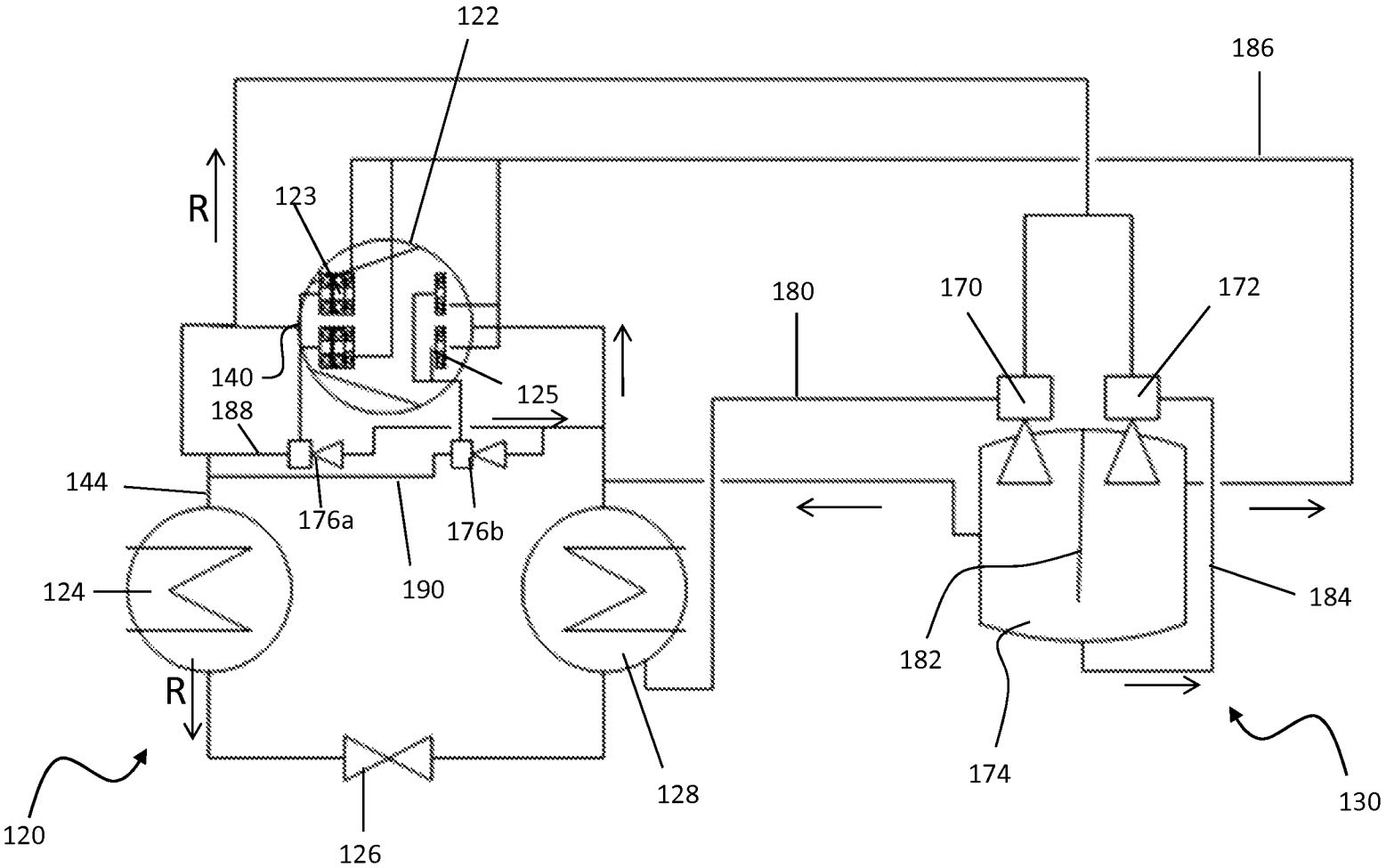
FIG. 4 is a schematic diagram of a refrigeration system including a lubrication system according to yet another embodiment.

With reference now to FIG. 4, yet another embodiment of the lubrication system 130 is illustrated. As shown, the system 130 includes a recovery ejector 170 and a misting ejector 172 associated with a tank 174, and at least one evacuation ejector 176. In the illustrated, non-limiting embodiment, the at least one evacuation ejector 176 includes a first evacuation ejector 176*a* configured to receive a lubricant enriched refrigerant from a first set of bearings 123 of the compressor and a second evacuation ejector 176*b* configured to receive a lubricant enriched refrigerant from a second set of bearings 125 of the compressor 122, due to the difference in pressure at the bearings 123, 125. However, embodiments where a single ejector 176 is configured to receive lubricant enriched refrigerant from both sets of bearings 123, 125 is also within the scope of the disclosure.

Both the recovery ejector 170 and the misting ejector 172 are arranged in fluid communication with the outlet 140 of the compressor 122 via conduit 178. Accordingly, a primary inlet of both the recovery ejector 170 and the misting ejector 172 is configured to receive the hot vapor refrigerant from the compressor outlet 140. The secondary inlet of the recovery ejector 170 is arranged in fluid communication with the evaporator 128 via conduit 180. Accordingly, the hot vapor refrigerant acts as the motive fluid to draw a lubricant rich liquid refrigerant from the evaporator 128 into the ejector 170. This lubricant rich refrigerant becomes entrained within the refrigerant vapor. The resultant refrigerant vapor having a small amount of lubricant entrained therein is expelled from the recovery ejector 170 into the tank 174. In an embodiment, the refrigerant and lubricant mixture output from the recovery ejector 170 accumulates within the tank 174.

The secondary inlet of the misting ejector 172 is arranged in fluid communication with the interior of the tank 174 via a conduit 184. Accordingly, the hot vapor refrigerant acts as the motive fluid to draw the lubricant rich refrigerant from the tank 174 into the misting ejector 172. This lubricant rich refrigerant becomes entrained within the refrigerant vapor. The resultant refrigerant vapor having a small amount of lubricant entrained therein is expelled from the misting ejector 172 into the tank 174. The recovery ejector 170 and the misting ejector 172 may be separated from one another via a baffle, screen, or other porous divider 182 arranged within the tank 174. In an embodiment, the refrigerant and lubricant mixture output from the ejector 172 is a dense fog-like vapor. By positioning the baffle between the recovery ejector 170 and the misting ejector 172, the amount of dense fog-like vapor refrigerant accumulates within the tank 174.

A conduit 186 extends from a portion of the tank 174 adjacent the misting ejector 172 to the plurality of bearings 123, 125 of the compressor 122. As the fog-like vapor refrigerant exceeds the volume of the tank 174, the mist of refrigerant and entrained lubricant flows through the conduit 186 to the bearings 123, 125 of the compressor 122.

Evacuation ejector 176*a* and 176*b* are also arranged in fluid communication with the outlet 140 of the compressor 122 via conduits 188, 190, respectively. As shown in the FIG., the fluid flow paths defined by conduits 188 and 190 are arranged in parallel to the fluid flow path 144 extending between the compressor outlet 140 and the condenser 124. Accordingly, the primary inlet of each evacuation ejector 176 is configured to receive the hot vapor refrigerant from the compressor outlet 140. The secondary inlet of each of the evacuation ejectors 176*a*, 176*b* is arranged downstream from and in fluid communication with the bearings 123, 125. Accordingly, the hot vapor refrigerant acts as the motive fluid to draw the lubricant rich refrigerant from the bearings 123, 125 into each of the evacuation ejectors 176*a*, 176*b*. This lubricant rich refrigerant becomes entrained within the refrigerant vapor before being returned to the compressor 122 as part of the normal refrigerant flow of the vapor-compression cycle. However, it should be understood that embodiments of the system 130 that use mist generating ejectors that are diverting from a traditionally designed ejector, such as ejector 132 for example, to provide better efficiency in generating an oil mist are also within the scope of the disclosure.

Each of the refrigeration systems 120 illustrated and described herein includes a low cost lubrication system that requires a limited number of components. Further, the plurality of components of the lubrication system 130 may be integrated directly into the compressor 122, such as into the compressor housing for example. Further, the lubrication systems 130 provide a lower oil charge, such as between 1-2 liters for example, resulting in improved operational efficiency of the system 120, a reduction in bearing losses, and an improved range of operation.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigeration system comprising:

a compressor for compressing a refrigerant, the compressor having a first inlet and a second inlet, separate from the first inlet;

a condenser for cooling the refrigerant;

an evaporator for heating the refrigerant, the evaporator being fluidly connected to the first inlet of the compressor; and a lubrication system for providing a lubricant mist to a movable component of the compressor, the lubricant mist being carried by the refrigerant to the movable component, the lubrication system including:

a first ejector arranged in fluid communication with the second inlet of the compressor and with the evaporator, wherein a stream of refrigerant is expelled from the first ejector and the stream of refrigerant has droplets of lubricant entrained therein;

a tank, wherein the stream of refrigerant having droplets of lubricant entrained therein is provided to the tank; and a secondary ejector arranged in fluid communication with the compressor and the tank, wherein the secondary ejector has a primary inlet and a secondary inlet, the primary inlet of the secondary ejector is coupled to the outlet of the compressor such that the refrigerant output from the compressor is a motive fluid of the secondary ejector.

2. The refrigeration system of claim 1, wherein the ejector has a primary inlet and a secondary inlet, the primary inlet being coupled to an outlet of the compressor such that the refrigerant output from the compressor is a motive fluid of the ejector.

3. The refrigeration system of claim 2, wherein the secondary inlet is coupled to an outlet of the evaporator such that a lubricant rich refrigerant is drawn into the ejector via the secondary inlet by the motive fluid.

4. The refrigeration system of claim 1, wherein the lubricant rich refrigerant is at least partially a liquid.

5. The refrigeration system of claim 1, wherein the outlet of the evaporator is arranged adjacent a bottom of the evaporator.

6. The refrigeration system of claim 1, wherein the lubricant rich refrigerant provided to the ejector from the evaporator is less than 2% of a total mass flow of refrigerant in the evaporator.

7. The refrigeration system of claim 1, wherein the secondary inlet of the secondary ejector is coupled to the tank such that the stream of refrigerant having lubricant entrained therein is drawn into the secondary inlet of the secondary ejector by the motive fluid.

8. The refrigeration system of claim 1, wherein a stream of refrigerant having droplets of lubricant entrained therein is output from the secondary ejector.

9. The refrigeration system of claim 8, wherein the stream of refrigerant output from the ejector has a greater amount of lubricant than the stream of refrigerant output from the secondary ejector.

10. The refrigeration system of claim 1, wherein an outlet of the secondary ejector is in fluid communication with the movable component of the compressor.

11. The refrigeration system of claim 10, wherein the stream of refrigerant having droplets of lubricant entrained therein output from the secondary ejector is directed into the tank, and at least one conduit couples the tank to the movable component to deliver the stream of refrigerant having droplets of lubricant entrained therein to the movable component.

12. The refrigeration system of claim 1, wherein the lubrication system further comprises a secondary ejector arranged in fluid communication with the compressor and the movable component.

13. The refrigeration system of claim 12, wherein the secondary ejector includes a primary inlet and a secondary inlet, the primary inlet being coupled to the outlet of the compressor and the second inlet being coupled to the movable component.

14. The refrigeration system of claim 1, wherein the movable component includes at least one bearing.

15. The refrigeration system of claim 14, wherein the at least one bearing includes a plurality of bearings, and the lubrication system is configured to deliver lubricant to the plurality of bearings, individually.

* * * * *